United States Patent [19]

Paliwal et al.

[11] Patent Number: 4,687,511

[45] Date of Patent: Aug. 18, 1987

[54] METAL MATRIX COMPOSITE POWDERS AND PROCESS FOR PRODUCING SAME

[75] Inventors: Muktesh Paliwal, Sayre; Walter A. Johnson, Towanda, both of Pa.

[73] Assignee: GTE Products Corporation, Stamford, Conn.

[21] Appl. No.: 863,653

[22] Filed: May 15, 1986

[51] Int. Cl.[4] ..... B22F 1/00

[52] U.S. Cl. ..... 75/0.5 B; 75/0.5 BA; 75/251

[58] Field of Search ..... 75/0.5 BA, 0.5 B, 251, 75/10.19

[56] References Cited

U.S. PATENT DOCUMENTS

| | | | |
|---|---|---|---|
| 3,738,824 | 6/1973 | Davis | 75/0.5 BA |
| 3,821,018 | 6/1974 | Grant | 75/251 |
| 4,251,599 | 2/1981 | McCormick | 75/0.5 BA |
| 4,356,029 | 10/1982 | Down | 75/0.5 BA |

*Primary Examiner*—Peter D. Rosenberg

*Attorney, Agent, or Firm*—Donald R. Castle; L. Rita Quatrini

[57] ABSTRACT

A composite powdered material is disclosed consisting essentially of particles having a metal matrix and one or more relatively uniform discrete dispersed reinforcement phases in the matrix, the reinforcement phases being of high strength or high hardness compounds selected from intermetallic compounds and metal compounds selected from the group consisting of metal borides, carbides, nitrides, oxides, carbonitrides, and mixtures thereof. The composite powdered particles are spheres of from about 25 to about 200 micrometers and the reinforcement phases have particles of a maximum size of less than about 10 micrometers. A process for producing this composite powder is disclosed which involves entraining in a carrier gas a plurality of powders wherein at least one of the powders supplies the metal from which the matrix is to be formed, and wherein at least two of the powders supply the constituents from which the reinforcement phases are to be formed. The powders are then fed through a high temperature zone to cause essentially complete melting and coalescence of the powders and to cause at least part of the constituents to combine to form at least one of the reinforcement phases, followed by resolidification.

4 Claims, No Drawings

METAL MATRIX COMPOSITE POWDERS AND PROCESS FOR PRODUCING SAME

BACKGROUND OF THE INVENTION

This invention relates to composite powdered materials having a metal (or alloy) matrix phase and one or more reinforcement phases. At least one of the reinforcement phases is formed insitu as a reaction product. This invention relates also to a process for producing the composite powdered material in which one or more of the reinforcement phases are formed insitu as powders containing the reactant constituents are passed through a high temperature zone. More particularly the high temperature zone is a plasma jet.

Metal matrix composites consist of intermetallic or ceramic phases dispersed in a metal or alloy matrix in which the combination results in improved or unique properties which could not be achieved using the individual components alone. The choices of the individual phases and their respective amounts depends on the desired physical, chemical, and/or mechanical properties of the product. For example, discontinuously reinforced metal matrix composites are attractive for applications requiring high strength levels at elevated temperatures. The reinforcement phase is selected for its high strength and high hardness and is typically an oxide, carbide, and/or a nitride. Typically these phases have very high melting points and are thermally stable in the alloy matrix. They are incorporated into the composite system by mechanical mixing with the alloy powders. Silicon carbide whisker or particulatereinforced aluminum alloys are fabricated using the composite approach. The process for fabricating whisker reinforced materials on a commercial basis has been developed by ARCO Metal's Silag Operation. A process for making particulatereinforced aluminum alloys has been developed by DWA Composites Incorporated. It utilizes a binder to make green "pancakes" of SiC and aluminum powders which are then stacked prior to hot pressing. U.S. Pat. No. 4,259,112, Dolowy, J. F., Webb, B. A., and Suban, E. C., Mar. 31, 1981.

Though specific details may differ, the powder metallurgy approach to making composites is based on mechanical mixing of the metal matrix and the reinforcement phase powders and subsequent consolidation.

Another composite technique called "compocasting" involves adding non-metals to partially solidified alloys. The high viscosity of the metal slurry prevents particulates from settling, floating, or agglomerating. Bonding of non-metal to metal is accomplished by interaction between the respective particles. Mehrabian, R., Riek, R. G., and Flemings, M. C., "Preparation and Casting of Metal-Particulate Non-Metal Composites", Metall. Trans., 5(1974) 1899–1905, and Mehrabian, R., Sato, A., and Flemings, M. C., "Cast Composites of Aluminum Alloys", Light Metals, 2 (1975) 177–193.

Still another method for producing powder metallurgy composite materials is by mechanical alloying. This is essentially a high energy ball milling operation which is done typically in a stirred ball mill called an attritor mill. High strength material results from mechanically working the alloy, because of incorporation of oxides and carbides during the milling, and strengthening mechanisms due to severe working resulting in fine grain and sub fine grain size.

U.S. Pat. Nos. 3,909,241 and 3,974,245 relate to processes for producing free flowing powders by agglomerating finely divided material, classifying the agglomerates to obtain a desired size range, entraining the agglomerates in a carrier gas, feeding the agglomerates through a high temperature plasma reactor to cause at least partial melting of the particulates, and collecting the particles in a cooling chamber containing a protective gaseous atmosphere, wherein particles are solidified.

SUMMARY OF THE INVENTION

In accordance with one aspect of this invention, there is provided a composite powdered material consisting essentially of particles having a metal matrix and one or more relatively uniform discrete dispersed reinforcement phases in the matrix, the reinforcement phases being of high strength or high hardness compounds selected from intermetallic compounds and metal compounds selected from the group consisting of metal borides, carbides, nitrides, oxides, carbonitrides, and mixtures thereof. The composite powdered particles are spheres of from about 25 to about 200 micrometers and the reinforcement phase or phases have particles of a maximum size of less than about 10 micrometers. At least one of the reinforcement phases has been created by an insitu reaction of two or more reactant constituents supplied by two or more powders.

In accordance with another aspect of this invention, there is provided a process for producing the above described composite powdered material. The process involves entraining in a carrier gas a plurality of powders wherein at least one of the powders supplies the metal or metal alloy from which the matrix is to be formed, and wherein at least two of the powders supply the reactant constituents from which at least one of the reinforcement phases is to be formed. The powders are then fed through a high temperature zone to cause essentially complete melting and coalescence of the powders and to cause at least part of the reactant constituents to combine to form at least one of the reinforcement phases.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The composite powdered material of this invention consists essentially of particles having a metal matrix and one or more relatively uniform discrete dispersed reinforcement phases in the matrix. The reinforcement phases are of high strength or high hardness compounds selected from intermetallic compounds and metal compounds selected from the group consisting of metal borides, carbides, nitrides, oxides, carbonitrides, and mixtures thereof, the composite powdered particles being spheres of from about 25 to about 200 micrometers. The reinforcement phase or phases have particles of less than about 10 micrometers in size. At least one of the reinforcement phases has been created by an insitu reaction of two or more reactant constituents, the constituents being supplied by two or more powders.

At least one of the powders supplies a metal or metal alloy from which the matrix is to be formed. At least two of the powders supply reactant constituents from which the reinforcement phase or phases is to be formed. The relative amounts of reactant constituents are chosen based on the stoichiometry of the reinforcement phase or phases and their desired fraction or fractions in the composite. In the subsequent step of passing through the high temperature zone, the reactant constituents combine to form at least one reinforcement phase or phases.

The starting powders are first agglomerated. The agglomeration is done by standard techniques, such as by spray drying or air drying a slurry of a binder and the powders.

In accordance with a preferred embodiment of this invention, the agglomerated powder particles are dewaxed by standard methods to remove the binder if deemed necessary before further processing.

The agglomerates are sintered by standard methods to impart sufficient strength to the particles for subsequent operations.

It is preferred that the agglomerated particles be classified to obtain the desired particles size ranges.

The agglomerated powders are entrained in a carrier gas which is preferably argon.

The agglomerated powders entrained in the carrier gas are fed through a high temperature zone which is at a temperature above the melting point of the metal or metal alloys from which the matrix phase is to be formed for a sufficient time to cause essentially complete melting of the powders and coalescence of the particles of the powders, and reaction of the reactant constituents to form at least one reinforcement phase.

The resulting high temperature treated particles are then resolidifed.

The source for the high temperature zone can be a plasma such as a DC or RF or a flame spray gun. The preferred high temperature source is a DC plasma.

In accordance with a preferred embodiment, the agglomerates are injected into the hot plasma jet using a carrier gas. The alloy particles forming the agglomerates are melted and coalesce. The reactant constituents, now dissolved in the metal or metal alloy matrix combine to form at least one reinforcement phase. As the molten agglomerates resolidify, additional phases can form depending on the alloy chemistry. Upon complete resolidification, the resulting composite powder particles are essentially spherical in shape, fully dense, with a very fine dispersion of the insitu formed reinforcement phase or phases. The typical size of the composite particles is from about 25 to about 200 micrometers in diameter. The typical size of the reinforcement phase particles is in the submicron to a few microns range, typically less than about 10 microns. By controlling the relative amounts of the starting materials and their composition, different phases and volume fractions of these different phases can be formed.

A typical plasma gun incorporates a conical thoriated tungsten cathode, a water-cooled annular copper anode which also serves as a nozzle, a gas injection system and a powder injection system. Gases used are selected for inertness and/or energy content. These include argon, hydrogen, helium, and nitrogen. Plasma gun operating power levels are generally in the 20 to 80 KW range. The location of the power injection port varies with the nozzle design and/or the powder material. It is either in the nozzle (anode) throat or downstream of the nozzle exit.

The plasma jet is not a uniform heat source. It exhibits steep temperature (enthalpy) and velocity gradients which determine the velocity and temperature achieved by the injected powder particles (agglomerates). In addition, the particle trajectories (and hence the temperature and veolcity) are affected by the particle size, shape, and thermophysical properties. The particle temperature is controlled by appropriately selecting the plasma operating conditions (plasma gas composition and flow rate and plasma gun power) and the injection parameters (injection port location and carrier gas flow rate.

The resolidification can be accomplished by several methods.

In accordance with the preferred embodiment, the resolidification is done by allowing the resulting high temperature treated particles to travel out of the high temperature zone to a cooler zone having a temperature below the solidification temperature of the matrix phase to allow the matrix to solidify.

The resolidification can be done also by impacting the resulting high temperature treated particles onto a solid substrate or into a liquid medium wherein the resolidification of the matrix takes place after the impact. In the case of impact with a solid substrate, a deposit of the composite material results.

A characteristic feature of the process of the present invention is that the insitu precipitation of solid reinforcement phase or phases is carried out by bringing together its separate reactant constituents which are in a liquid state (dissolved in the liquid metal or alloy matrix phase). After the reaction in the plasma jet, the remaining liquid resolidifies in flight as the melted agglomerates cool. The result is a composite powder with a very fine and homogeneous dispersion of the reinforcement phase.

The concept of using a liquid metal bath to react dissolved elements to form a new phase is known. The process is known by various names such as: the "auxiliary metal bath process", the "menstrum process", or the "McKenna Process". The process is generic in nature and has been used for the production of hard compounds such as carbides, borides, silicides, nitrides, and carbonitrides (R. Kieffer and G. Jangg: Powder Metallurgy International, Vol. 4, No. 4, 1972, pp. 191–192), (R. Kieffer and H. Rassaerts, Int. J of Powder Metallurgy, Vol. 2, No. 2, 1966, pp. 15–22), B. Champaigne, S. Dallaire, and A. Adnot: J. of Less Common Metals, (14), 1968, ppL21-L25). In these processes the formed reaction product is separated from the liquid metal bath. U.S. Pat. No. 4,540,546 discloses a melting process which is essentially the same as the Menstrum of McKenna process. The primary difference relates to subsequent melt spinning or gas atomization process. U.S. Pat. No. 4,540,546 does not address technical difficulties associated with melt crucible reactions and the ability to obtain precise and controlled pour rates through both crucible nozzles. Such pour rate inconsistancies can result in a non-homogeneous product. In contrast, in the process as disclosed in this invention, the reaction is carried out in "metal bath" which is a droplet. The product is approximately the same size as the starting aggomerates, that is, from about 25 to about 200 micrometers. The process does not require any subsequent operations such as atomization or melt spinning to make fine powder particles. Carrying out the insitu reaction based on the same principles as in the "auxiliary bath" process in smaller quantities, that is, in small melted agglomerates as described in this invention leads to a very fine reaction product uniformly dispersed in the metal or metal alloy.

The composite powders made by the process of this invention can be consolidated to net shape using conventional powder metallurgy techniques such as pressing and sintering, isostatic pressing, forging, extrusion, and combinations thereof.

To more fully illustrate this invention, the following nonlimiting example is presented. Example A copper based composite is required for applications requiring high strength at elevated temperatures along with good electrical conductivity. Accordingly, TiB2 is chosen as the reinforcement phase since it exhibits high strength, high hardness values as well as high electrical conductivity. The starting raw materials are: (1) titanium containing copper alloy powder, and (2) boron containing copper alloy powder. These powders are agglomerated by conventional spray drying techniques. The resulting spray dried agglomerates are then dewaxed and sintered in a furnace in a controlled environment. The agglomerates are then slowly cooled to room temperature. The dewaxed and sintered agglomerates are then classified to obtain the desired size ranges. The agglomerates are then melted using a D.C. plasma torch. The plasma-treated particles are resolidified in flight. The resulting composite powders contain TiB2 as a reinforcement phase dispersed in the copper based alloy.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a composite powdered material consisting essentially of particles having a metal matrix phase selected from the group consisting of metals and metal alloys, and one or more relatively uniform discrete dispersed reinforcement phases in said matrix, said reinforcement phase or phases being of high strength or high hardness compounds selected from intermetallic compounds and metal compounds selected from the group consisting of metal borides, carbides, nitrides, oxides, carbonitrides, and mixtures thereof, said composite powdered particles being spheres of from about 25 to about 200 micrometers and wherein said reinforcement phase or phases have particles of a maximum size of less than about 10 micrometers, said process comprising:

(a) entraining in a carrier gas a plurality of powders wherein at least one of said powders supplies a metal or metal alloy from which the matrix is to be formed, and wherein at least two of said powders supply the reactant constituents from which at least one of said reinforcement phases is to be formed;

(b) feeding said powders through a high temperature zone to cause essentially complete melting and coalescence of said powders and to cause at least part of said reactant constituents to combine to form at least one of said reinforcement phases; and (c) resolidifying the resulting high temperature treated powder particles to form said composite powdered material.

2. A process of claim 1 wherein said powders are agglomerated and sintered prior to being passed through said high temperature zone.

3. A process of claim 1 wherein said high temperature zone is a plasma.

4. A composite powdered material consisting essentially of particles having a metal matrix and one or more relatively uniform discrete dispersed reinforcement phases in said matrix, said reinforcement phases being of high strength or high hardness compounds selected from intermetallic compounds and metal compounds selected from the group consisting of metal borides, carbides, nitrides, oxides, carbonitrides, and mixtures thereof, said composite powdered particles being spheres of from about 25 to about 200 micrometers and wherein said reinforcement phase or phases have particles of less than about 10 micrometers in size, and wherein at least one of said reinforcement phases has been created by an insitu reaction of two or more reactant constituents, said constituents being supplied by two or more powders.

* * * * *